United States Patent [19]

Roman, Jr.

[11] 4,225,206

[45] Sep. 30, 1980

[54] ELECTRICAL CONNECTOR FOR ELECTROMAGNETIC FUEL INJECTOR

[75] Inventor: Michael J. Roman, Jr., Warren, Ohio

[73] Assignee: General Motors Corporation, Detroit, Mich.

[21] Appl. No.: 64,014

[22] Filed: Aug. 6, 1979

[51] Int. Cl.[3] ..... H01R 13/20

[52] U.S. Cl. ..... 339/91 R; 339/94 R

[58] Field of Search ..... 339/60, 91 R, 94

[56] References Cited

U.S. PATENT DOCUMENTS

| | | | |
|---|---|---|---|
| 2,015,590 | 9/1935 | Cavanaugh et al. | 339/91 R |
| 2,984,812 | 5/1961 | Caferro | 339/52 |
| 3,088,089 | 4/1963 | Gregoire | 339/94 |
| 3,760,332 | 9/1973 | Berkovits et al. | 339/66 R |
| 3,781,764 | 12/1973 | Johnson | 339/94 |
| 3,836,935 | 9/1974 | Johnson | 339/17 LM |
| 3,853,388 | 12/1974 | Heimbrock | 339/192 RL |
| 3,869,191 | 3/1975 | Tolnar, Jr. et al. | 339/91 R |
| 4,080,025 | 3/1978 | Garnier et al. | 339/91 R |
| 4,093,332 | 6/1978 | Simko | 339/91 R |
| 4,123,131 | 10/1978 | Pearce et al. | 339/117 R |
| 4,153,319 | 5/1979 | Plyler et al. | 339/75 P |

*Primary Examiner*—Joseph H. McGlynn

*Attorney, Agent, or Firm*—F. J. Fodale

[57] ABSTRACT

An electrical socket connector is detachably secured to an electromagnetic fuel injector having a pair of upstanding pin terminals located on opposite sides of and radially spaced from an upstanding central boss. The electrical socket connector has a connector body comprising a pair of longitudinal, laterally spaced terminal housings each having a pin grip terminal disposed therein and receiving one of the pin terminals. The terminal housings are connected together by integral bridges and a pair of longitudinally spaced, vertical latch arms are disposed between the terminal housings and pivotally connected thereto for latching onto the central boss. A seal member comprises a pair of elastomeric sleeves which are connected by an integral saddle at one end and mounted on the depending sockets respectively. Each sleeve has an inward circular sealing lip which seals around a plastic sleeve surrounding the pin terminal inserted into its associated socket.

3 Claims, 4 Drawing Figures

ELECTRICAL CONNECTOR FOR ELECTROMAGNETIC FUEL INJECTOR

This invention relates generally to electrical connectors and more particularly to an electrical socket connector at the end of insulated conductor wires which comprise electrical terminals housed in a connector body of molded relatively hard plastic.

The object of this invention is to provide an electrical socket connector of this type which is especially suitable for making an electric connection to an electrical device such as the electromagnetic fuel injector disclosed in FIGS. 5–9 of U.S. patent application Ser. No. 941,754 filed by James D. Palma on Sept. 13, 1978 for "Electromagnetic Fuel Injector".

This fuel injector has a cover in the form of a circular pole piece 162 which has an upstanding central boss **162*b* housing a spring adjusting screw 170. The pole piece 162 has a pair of diametrically opposed holes located radially outwardly of the boss 162*b* through which plastic studs 162*a* project. Pin terminals 166 connected to the terminal ends of an actuating coil for the electromagnetic fuel injector project from the ends of the plastic studs 162*a***.

The fuel injector is intended for use in a throttle body fuel injection system for a spark ignition internal combustion engine. This application requires an electrical socket connector which provides a sealed electrical connection while being of relatively low profile so as to fit beneath an air cleaner for the throttle body.

Consequently a more specific object of the invention is to provide a sealed electrical socket connector of relatively low profile which can be coupled to an electrical device having a pair of upstanding pin terminals located on opposite sides of a central upstanding boss or projection.

Another object of this invention is to provide a sealed low profile electrical socket connector which can also be detachably secured to such an electrical device.

Figure 1:
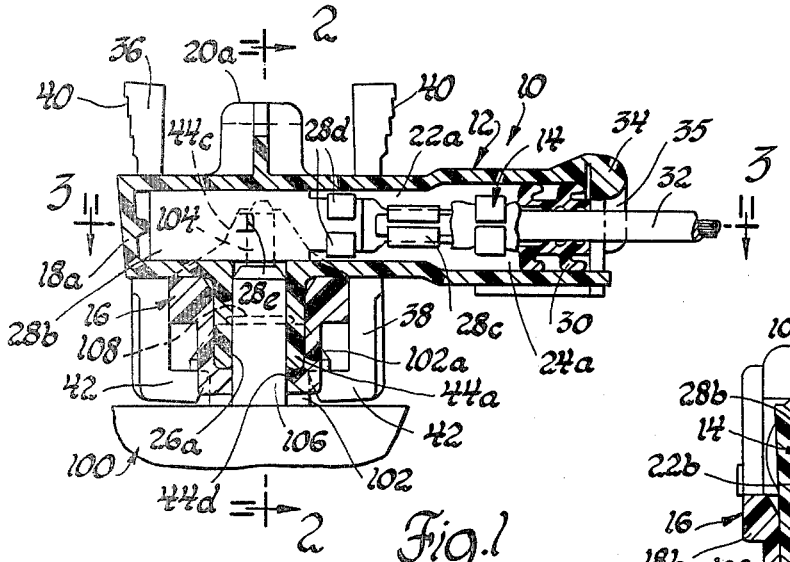
Figure 2:
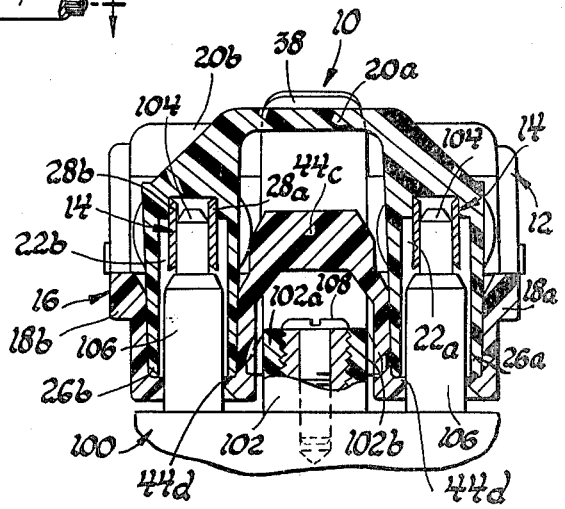
Figure 4:
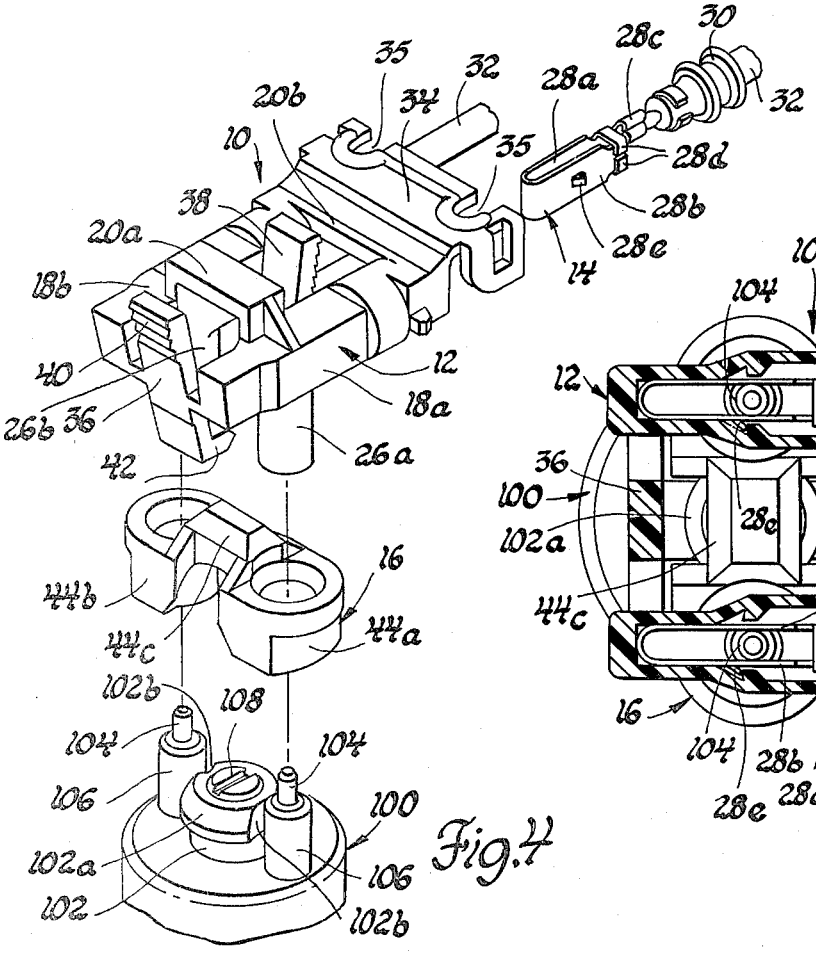
Figure 3:
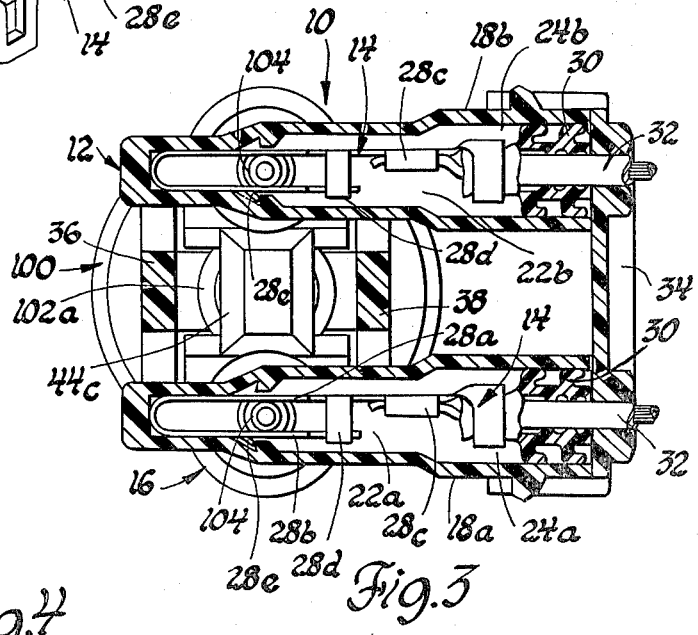

Other objects and features of the invention will become apparent to those skilled in the art as the disclosure is made in the following detailed description of a preferred embodiment of the invention as illustrated in the accompanying sheet of drawing in which:

FIG. 1 is a longitudinal section of an electrical connector according to this invention, FIGS. 2 and 3 are sections taken substantially along the lines 2—2 and 3—3 of FIG. 1, respectively; and FIG. 4 is an exploded perspective view of the electrical connector shown in FIGS. 1, 2 and 3.

Referring now to the drawings, the electrical socket connector 10 comprises a connector body 12, a pair of pin grip terminals 14 and a seal member 16.

The electrical connector 10 is designed for detachable securement to an electrical device 100 having an upstanding central boss 102 flanked by a pair of protruding pin terminals 104 as will hereinafter more fully appear.

The connector body 12 is made from a moldable, electrically insulative, relatively hard thermoplastic material such as nylon. The connector body 12 comprises a pair of longitudinal terminal housings **18*a* and 18*b* which are connected to each other in a laterally spaced, parallel arrangement by integral bridges 20*a* and 20*b***.

The terminal housings **18*a*, 18*b* respectively define longitudinal terminal receiving cavities 22*a*, 22*b* which are closed at the forward end of the connector body 12. The forward portions of the terminal cavities are generally rectangular while the respective rearward portions 24*a*, 24*b* are circular and provide rear openings for receiving the pin grip terminals 14. The median portions of the housings 18*a* and 18*b* have depending annular sockets 26*a* and 26*b*, respectively. The annular sockets 26*a* and 26*b* are parallel to each other and define vertical passageways leading into the respective longitudinal terminal cavities 22*a* and 22*b* as shown in FIGS. 1 and 2**.

Each pin grip terminal 14 comprises an elongated, U-shaped, contact having two flat blades **28*a* and 28*b* which engage one of the pin terminals 104 across its diameter. The base of the blade 28*a* is contiguous an attachment portion 28*c* comprising crimp barrels which attach the pin grip terminal 14 and a seal sleeve 30 to the end of an insulated conductor wire 32**. Further details on the manner in which the crimp barrels attach a terminal and seal sleeve to the end of an insulated conductor wire are described in U.S. patent application Ser. No. 912,835 filed by Harold G. Hawkins on June 5, 1978 for an "Assembly for Sealed Electrical Connector".

The base of the blade **28*a* has two transverse tabs 28*d* with bent ends which are disposed outside the free end of the blade 28*b* and restrain its lateral movement away from the blade 28*a*. The blade 28*b* has a struck out lock tab 28*e* which cooperates with internal shoulders in the cavities 22*a* and 22*b* to retain a particular pin grip terminal 14 in its respective cavity as shown in FIG. 3. When the pin grip terminals 14 are properly positioned and retained in the cavities 22*a* and 22*b*, the circular lips of the seal sleeves 30 engage the wall of the circular cavity portions 24*a* and 24*b*** and seal the rear openings of the cavities.

The connector body 12 includes a secondary lock flap 34 which has a pair of slots 35 and which is connected to the rearward bridge **20*b* by an integral flexible hinge. After the pin grip terminals 14 are assembled in the cavities 22*a* and 22*b*, the secondary lock flap 34 is moved from the open position shown in FIG. 4 to the closed position shown in FIG. 1. In the closed position, the flap 34 is behind the seal sleeves 30 and the insulated conductor wires 32 pass through the slots 35. The slots 35, however, are not wide enough to permit passage of the seal sleeves 30. Thus the closed flap 34 cooperates with the ends of the seal sleeves 30 to provide a secondary lock which prevents the pin grip terminals 14 from being pulled out of the cavities 22*a*, 22*b* by the conductor wires 32. The flap 34 has side pieces which cooperate with projections on the connector body 12** to latch the flap in the closed position. The latch is so designed that the secondary lock flap will continue to function even if all material in the hinge area completely separates after the flap is fully closed and latched.

The forward bridge **20*a* is preferably located in the plane of the parallel depending annular sockets 26*a* and 26*b* so that the connector body 12 is very rigid in the lateral direction at this location. The forward bridge 20*a* and annular sockets 26*a* and 26*b* are spaced from the forward end of the connector body 12 to accommodate part of a latch mechanism for detachably securing the connector body 12 to the electrical device 100**.

The latch mechanism takes the form of a pair of integral vertical latch arms 36 and 38 disposed between the terminal housings **18*a* and 18*b*. Each of the latch arms is connected to the confronting side walls of each of the terminal housings 18*a*, 18*b* by connectors of small cross section which serve as pivots for the vertical latch arms 36 and 38. The latch arms 36, 38 are connected to the terminal housings 18***a*, 18*b* forwardly and rearwardly of the bridge 20*a* respectively and each latch arm projects above and below the terminal housings 18*a*, 18*b*.

The upper ends of the latch arms 36, 38 have finger grips 40 while the lower ends have hooks 42 which face each other and which move away from each other when the finger grips 40 are squeezed toward each other.

The forward bridge 20*a* is raised so that it acts as a stop which limits the squeezing movement of the finger grips 40 toward each other to prevent the pivots for the latch arms 36, 38 from being overstressed. The top surface of the raised bridge 20*a* also provides a convenient pad for applying a finger force to the connector body 12 to couple the connector 10 to the electrical device 100.

The seal member 16 is molded from an elastomeric material such as an epichlorohydrin compound. The seal member 16 comprises a pair of seal sleeves 44*a*, 44*b* which are connected together by an integral saddle 44*c* at their upper end. The bores of the sleeves 44*a*, 44*b* are sized to snugly fit on and seal against the outer surfaces of the sockets 26*a*, 26*b*, respectively. Each of the sleeves 44*a*, 44*b* has an inward circular sealing lip 44*d* which is adjacent the lower end of its associated socket and which projects inwardly of the passage of the associated socket for sealing around a plastic stud 106 received in the passage as shown in FIGS. 1 and 2.

The saddle 44*c* is narrow so that it passes between the hooks 42 (in the unstressed position of the latch arms 36, 38 shown in FIG. 1) to facilitate assembling the seal member 16 to the connector body 12.

The saddle 44*c* is also raised so that it fits between the terminal housings 18*a* and 18*b* out of the way of the upstanding boss 102 of the electrical device 100.

The electrical socket connector 10 is especially suitable for connection to an electrical device, such as a fuel injector indicated generally at 100 in the drawings. The device 100 has a cover which has an upstanding central boss 102 and a pair of pin terminals 104 which project out of studs 106 of plastic or other insulating material. In this particular device, the central boss 102 is used to house an adjusting screw 108 and has an enlarged head 102*a* which provides an excellent catch member for detachably securing the electrical socket connector 12. The portions of enlarged head 102*a* near the plastic studs 106 and pin terminals 104, however, have arcuate cutouts 102*b* to provide room for the seal sleeves 44*a* and 44*b* to fit between the boss 102 and the studs 106 when the electrical connector 10 is plugged onto the electrical device 100.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical connector for an electrical device having a pair of upstanding pin terminals located on opposite sides of and radially spaced from an upstanding central boss, comprising:

a connector body having a pair of longitudinal, laterally spaced terminal housings each having a depending vertical socket which is laterally spaced from and parallel to the depending socket of the other terminal housing, said connector body further comprising an integral bridge connecting the terminal housings and a pair of longitudinally spaced, vertical latch arms disposed between the terminal housings, and pivotally connected to the terminal housings forwardly and rearwardly of the bridge respectively, a pin grip terminal disposed in each terminal housing for engaging a pin terminal means received in the terminal housing via its associated socket, and a seal member comprising a pair of laterally spaced elastomeric sleeves connected by an integral saddle at one end, said sleeves being mounted on and sealingly engaging the depending sockets respectively, each sleeve having an inward circular sealing lip which is adjacent an open end of its associated socket and which projects radially inwardly of the associated socket passage for sealing around pin terminal means inserted into the associated socket.

2. An electrical connector for an electrical device having a pair of upstanding pin terminals located on opposite sides of and radially spaced from an upstanding central boss, comprising:

a connector body having a pair of longitudinal, laterally spaced terminal housings each having a depending vertical socket which is laterally spaced from and parallel to the depending socket of the other terminal housing, said connector body further comprising an integral raised U-shaped bridge connecting the terminal housings at the longitudinal location of the depending sockets, and a pair of longitudinally spaced, vertical latch arms disposed between the terminal housings, and pivotally connected to the terminal housings forwardly and rearwardly of the bridge respectively, said latch arms extending above and below the terminal housings and having hooks at their lower ends projecting toward each other for engaging an enlarged head of the upstanding central boss, a pin grip terminal disposed in each terminal housing for engaging pin terminal means received in the terminal housing via its associated socket, and a seal member comprising a pair of laterally spaced elastomeric sleeves connected by an integral saddle at one end which is narrow enough to pass between the hooks of the latch arms when the latch arms are in an unstressed condition, said sleeves being mounted on and sealingly engaging the depending sockets respectively, each sleeve having an inward circular sealing lip at its opposite end which projects radially inwardly of the passage of its associated socket for sealing around pin terminal means inserted into the associated socket.

3. An electrical connector for an electrical device having a pair of upstanding pin terminals located on opposite sides of and radially spaced from an upstanding central boss, comprising:

a connector body having a pair of longitudinal, laterally spaced terminal housings each having a depending vertical socket which is laterally spaced from and parallel to the depending socket of the other terminal housing, said connector body further comprising an integral raised U-shaped bridge connecting the terminal housings at the longitudinal location of the depending sockets, and a pair of longitudinally spaced, vertical latch arms disposed between the terminal housings, and pivotally connected to the terminal housings forwardly and rearwardly of the bridge respectively, said latch arms extending above and below the terminal housings and having hooks at their lower ends projecting toward each other for engaging an enlarged head of the upstanding central boss, said latch arms having their upper ends engageable with the raised bridge to prevent overstressing of the pivots for the latch arms, a pin grip terminal disposed in each terminal housing for engaging a pin terminal received in the terminal housing via its associated socket, and a seal member comprising a pair of laterally spaced elastomeric sleeves connected by an integral raised saddle at one end which is narrow enough to pass between the hooks of the latch arms when the latch arms are in an unstressed condition, said sleeves being mounted on and sealingly engaging the depending sockets respectively with said saddle being disposed between said terminal housings out of the way of the upstanding central boss, each sleeve having an inward circular sealing lip at its opposite end which projects radially inwardly of the passage of its associated socket for sealing around pin terminal means inserted into the associated socket passage.

* * * * *